US005791391A

United States Patent [19]

Carter

[11] Patent Number: 5,791,391

[45] **Date of Patent: *Aug. 11, 1998**

[54] DISPLAY SYSTEM

[76] Inventor: Wallace Thomas Carter, 118 Holiday Hills Dr., Wilmington, N.C. 28409

[ * ] Notice: This patent issued on a continued prosecution application filed under 37 CFR 1.53(d), and is subject to the twenty year patent term provisions of 35 U.S.C. 154(a)(2).

[21] Appl. No.: 664,347

[22] Filed: Jun. 17, 1996

[51] Int. Cl.[6] ..... A47G 5/00

[52] U.S. Cl. ..... 160/135; 160/351

[58] Field of Search ..... 160/135, 351, 160/352, 237, 405; 52/239, 238.1, 720.1, 724.5, 727, 736.1, DIG. 4; 40/605, 606, 610

[56] References Cited

U.S. PATENT DOCUMENTS

| | | | |
|---|---|---|---|
| 2,044,422 | 6/1936 | Davidson . | |
| 2,193,469 | 3/1940 | Ashton . | |
| 3,928,930 | 12/1975 | Attwood . | |
| 4,711,046 | 12/1987 | Herrgord | 160/135 X |
| 4,865,111 | 9/1989 | Perutz . | |
| 4,979,554 | 12/1990 | Nelson . | |
| 5,131,448 | 7/1992 | Miller | 160/135 |
| 5,388,382 | 2/1995 | Brooks | 160/135 X |
| 5,439,043 | 8/1995 | Carter . | |

*Primary Examiner*—David M. Purol
*Attorney, Agent, or Firm*—Diller, Ramik & Wight, PC

[57] ABSTRACT

A portable display includes a central display panel and opposite side tubular hollow end panels or columns constructed from a single sheet of substantially resilient elongated material. Each column is formed by rolling a side edge portion rearward bringing a tubular polygonal reinforcing member carried by each side edge portion into magnetically attracted sectirement with another hollow member. Hubs are inserted into the interior of the side columns to lend rigidity thereto, and two such displays or display sections can be stacked one relative to the other to transform a table-top display to a floor display. In this stacked configuration magnetically attractable securing elements hold the lower edge portion of an upper display section intimately relative to an upper edge portion of a lower display section. The resilient nature of the elongated panel(s) allows a variation in central panel configuration from generally uni-planar to concave or convex absent at any time an abrupt juncture at the display side thereof which presents a virtually unbroken aesthetic appearance to the overall display.

32 Claims, 3 Drawing Sheets

FIG. 4
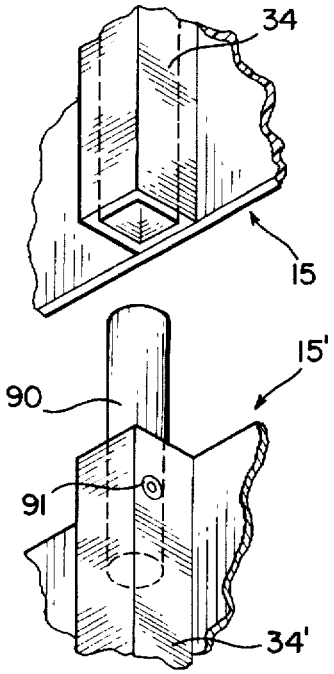
FIG. 6
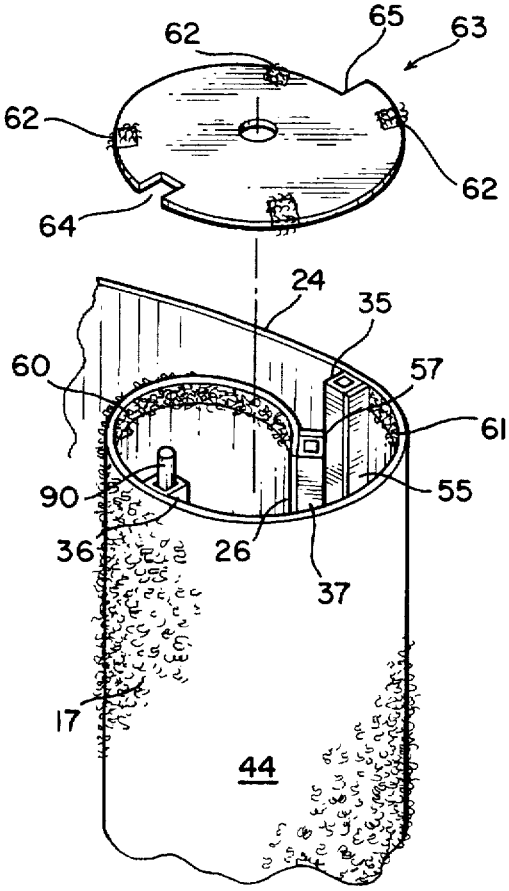
FIG. 5
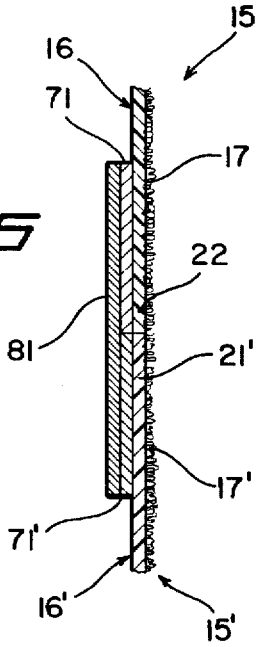
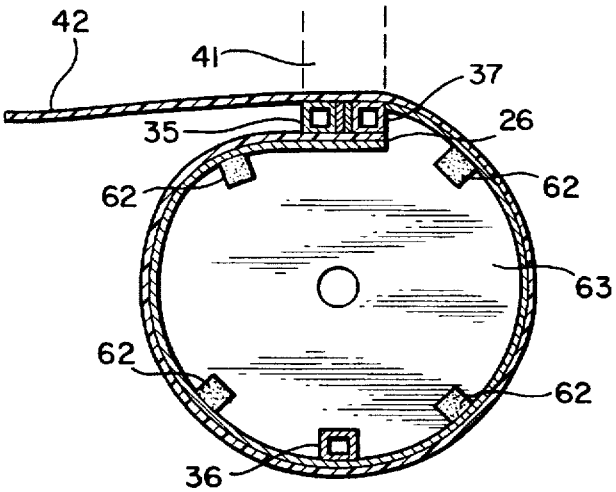
FIG. 7

DISPLAY SYSTEM

BACKGROUND OF THE INVENTION

This invention relates to a display system which is portable, free standing and can be readily erected, knocked-down, packed, transported, unpacked and/or repacked for display purposes at sales presentations, press conferences, conventions, seminars and the like.

The display system of the present invention is designed to provide a relatively large display surface without sacrificing portability, and does so through the utilization of side columns and a central panel portion therebetween which is contemporarily curved to provide an aesthetically attractive three dimensional appearance. The display system has the flexibility of being reconfigured into smaller or larger free standing displays or table top displays.

The display system of the present invention constitutes a number of unobvious improvements over the display systems disclosed in U.S. Pat. No. 5,439,043 granted Aug. 8, 1995 and pending application Ser. No. 08/520,177 filed Aug. 28, 1995, each in the name of Wallace T. Carter.

The patented display system includes at least one display panel and a column or tubular end panel secured to each side edge of the display panel with the display panel and the columns being each formed from a single sheet of resilient material. Opposite edges of two of the sheets are rolled into a generally hollow configuration. When so rolled to form a hollow side column, adjacent edges of each hollow side column are magnetically secured together and a U-shaped elongated member connects each column to an associated edge of the third sheet which defines a central display panel. In this fashion two relatively flat sheets of resilient material can be each formed into a column with each column being then secured to opposite vertical edges of a central display panel thereby forming a relatively aesthetic display. However, the juncture between each column and the central display panel is quite abrupt and is not aesthetically attractive, and though more aesthetically attractive than heretofore provided, improvements thereover were highly desirable and such were provided in the display of Ser. No. 08/520,177 in which the abrupt juncture between the columns and the central display panel were rendered less obtrusive and more aesthetic, though not reaching ultimate aesthetic appearance while retaining ultimate functionality.

SUMMARY OF THE INVENTION

The novel display of the present invention is similar to those disclosed in the latter-identified patent and application in that it includes at least one central display panel and a hollow column at each side edge thereof. However, the display of the present invention is constructed from a single substantially resilient elongated panel having side panel portions which are rolled to form upstanding hollow side supports or side columns. Thus, there is no abrupt juncture visible at the display side of the display, and the entire display has an extremely aesthetic appearance because of the unbroken flow created by the single panel. The display is aesthetically superior to the displays or display systems of the latter-described patent and pending application, yet the functionality and structural stability remains substantially unchanged. Moreover, since the present display is constructed from but a single substantially resilient elongated panel, the time required for both assembly and knock-down is reduced, as compared to the latter described display systems.

The novel display or display system of the present invention includes at least two substantially resilient side panel portions and a central panel portion therebetween. The side panel portions are rolled in opposite directions to thereby define a columnar upstanding side portion or side column at each of opposite sides of the central panel portion. Conventional means, such as the magnetically attractive elements utilized in the latter-described patent and application maintain the upstanding side columns in their columnar configuration. In this manner, the entire display is formed absent junctures, particularly abrupt junctures between separate side columns and a separate central display panel therebetween. Thus, the aesthetics of the display of the present invention is markedly superior of that afforded by the prior art displays.

Since the single elongated panel is constructed from resilient material, the central panel portion can be curved such as to open concavely in a forward-facing display direction which also enhances the aesthetic appearance thereof.

Two such displays can be stacked or assembled one upon the other, and magnetic attractable means are utilized to secure a lowermost edge of an uppermost panel to an uppermost edge of a lowermost panel to thus impart rigidity to the overall display.

The display also includes a plurality of tubes which are disposed vertically and are spaced longitudinally from each other. A pin can be inserted into aligned tubes of upper and lower display panels to hold the same interlocked during both assembly/set-up and use.

Due to the structurally simplistic construction of the present display, the same can be readily assembled and disassembled, particularly when a display is formed from two stacked display panels each carrying the aforesaid tubular members at rear surfaces thereof. Each panel is placed display side down upon a supporting surface with a lower edge of an upper panel adjacent an upper edge of a lower panel. The tubular elements are then aligned and are joined by pins telescopically positioned therein. The side portions of the panels are then rolled rearward to form the columns and the totality of the display is essentially thus quickly set-up and, of course, can be as quickly and readily knocked-down.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 4 is a fragmentary perspective view, and illustrates a pin telescopically received in aligned pairs of tubular members of the two display sections for effecting alignment therebetween during assembly and use.

FIG. 5 is an enlarged cross-sectional view taken generally along line 5—5 of FIG. 2, and illustrates the manner in which magnetically attractive elements, one carried by each of the display sections and one in spanning relationship thereto, maintain the edges in intimate conformity with each other.

FIG. 6 is a fragmentary exploded view, and illustrates the manner in which the resilient panel is rolled to form a side support column held together by magnetically attractive strips held together by tubular members and a hub positioned incident to its insertion within the side column for maintaining the configuration thereof.

FIG. 7 is an enlarged cross-sectional view taken generally along line 7—7 of FIG. 2, and illustrates the magnetically attractive elements maintaining the side column in its columnar configuration and a lower hub positioned therein.

DESCRIPTION OF THE PREFERRED EMBODIMENT

Figure 1:
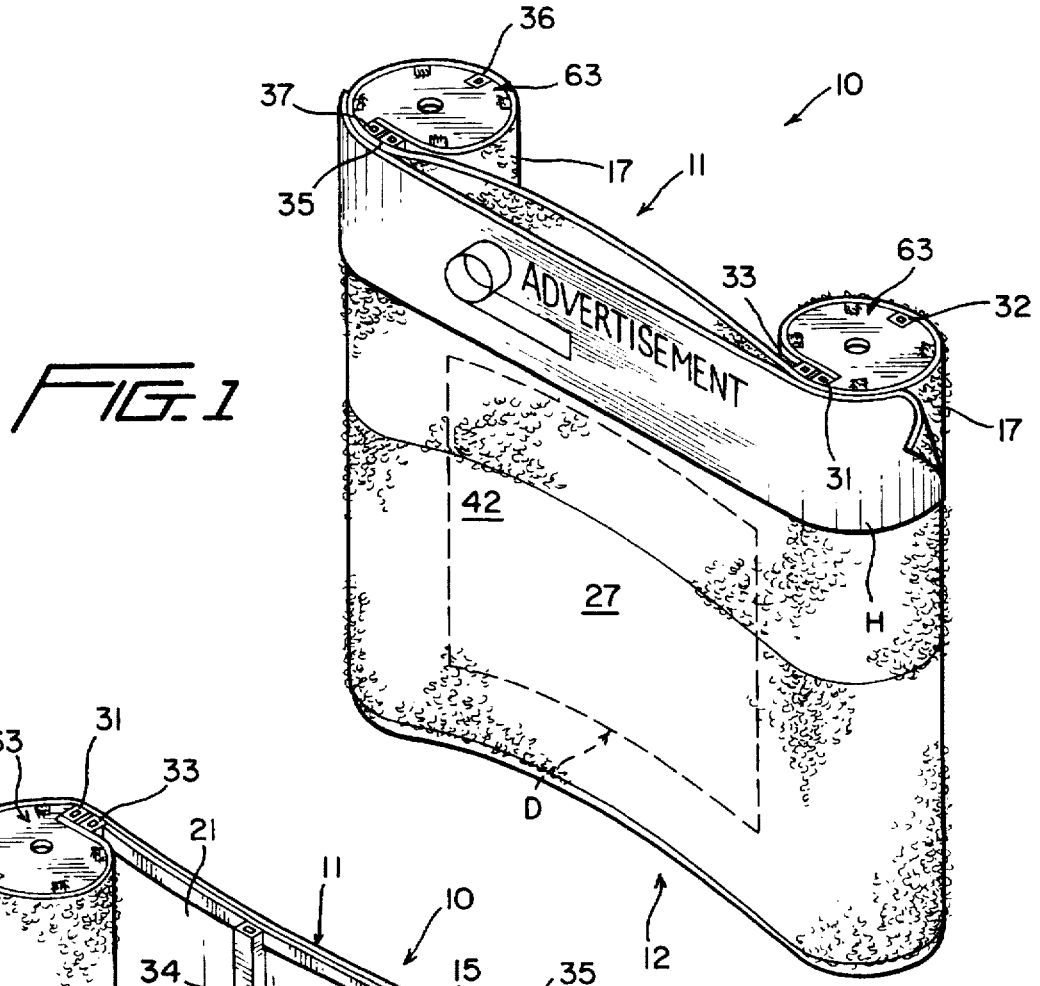
FIG. 1 is a front perspective view of a novel display constructed in accordance with this invention, and illustrates upper and lower display panels each formed of a single resilient elongated panel having side panel portions rolled to form side columns.
Figure 2:
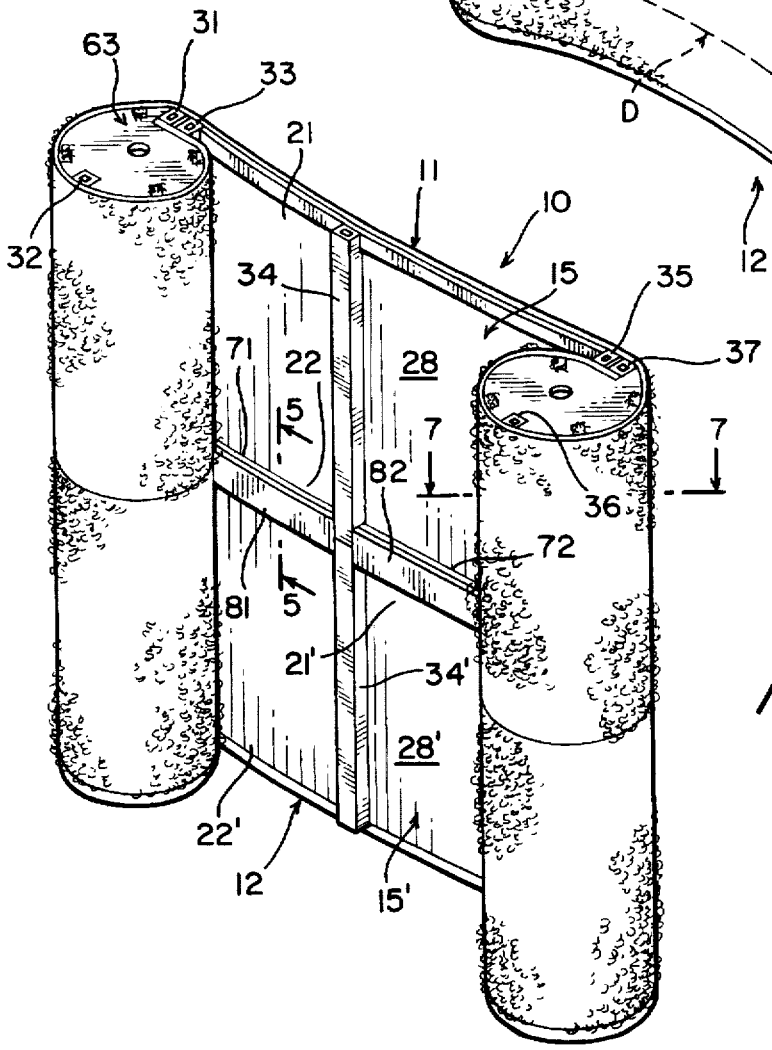
FIG. 2 is a rear perspective view of the display of FIG. 1, and illustrates a pair of several vertically aligned tubular members or tubular elongated rods removably secured together by telescopic pins, as illustrated in FIG. 4, and magnetically attractive belts disposed generally horizontally for securing contiguous horizontal edge portions of the display sections to each other.
Figure 3:
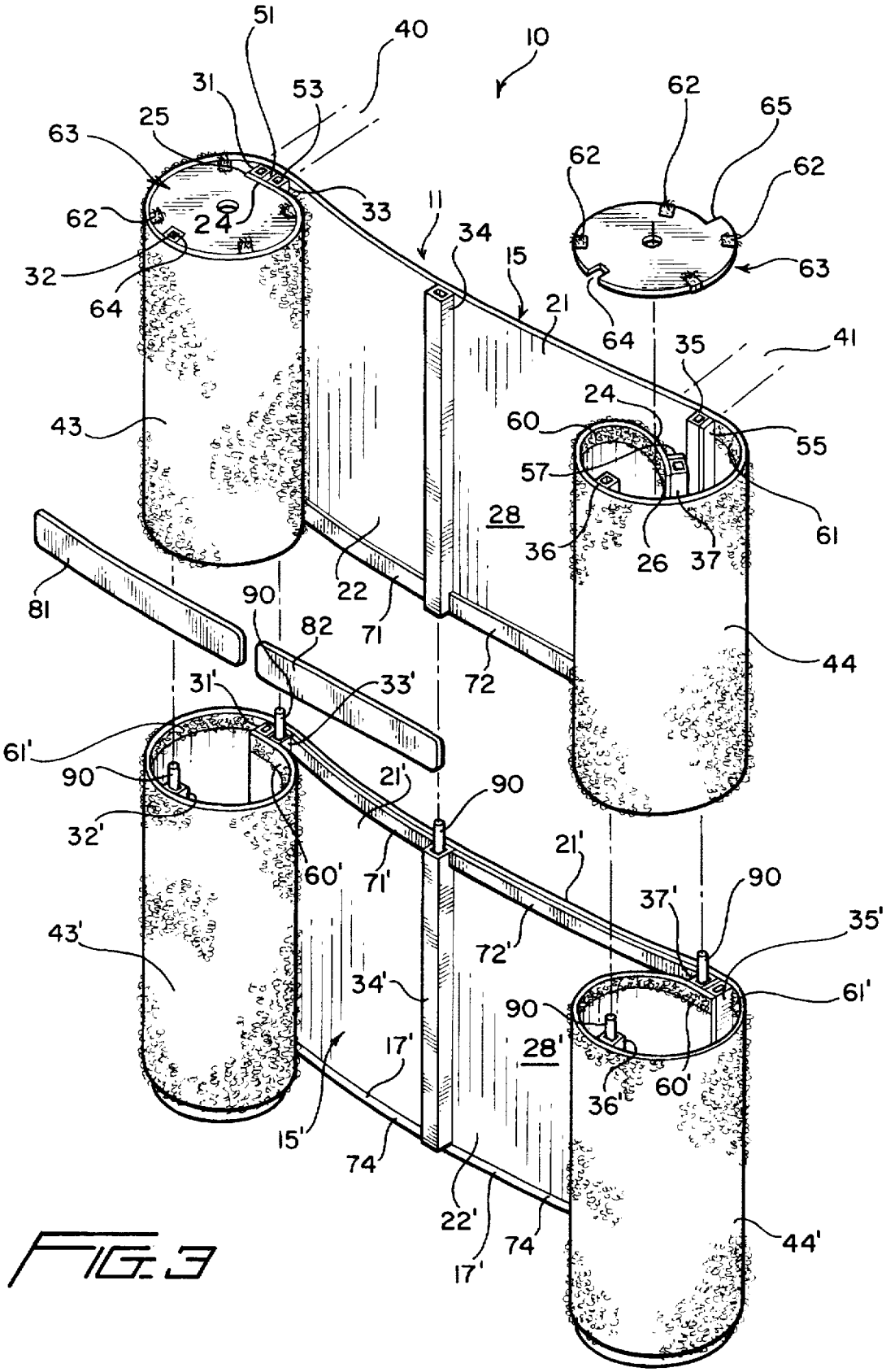
FIG. 3 is an exploded rear perspective view of the display of the invention, and illustrates the manner in which the various components are unitized and assembled to form the erected display of FIGS. 1 and 2.

A novel display, display system or portable display constructed in accordance with this invention is illustrated in FIGS. 1 through 3 of the drawings and is generally designated by the reference numeral 10.

The display 10 is formed of two separate identical display sections, namely, a display section 11 and a display section 12. The display sections 11 and 12 are superposed and assembled together as shown in FIGS. 1 and 2 when the display 10 is utilized as a floor display. However, each of the display sections 11, 12 is itself individually a display which might, for example, be utilized as a table display. However, since the display sections 11, 12 of the display 10 are identical, the display section 11 will be described in detail and identical primed reference numerals will indicate identical structure of the display section 12.

The display section 11 of the display 10 includes a substantially uniformly resilient elongated panel 15. The panel 15 is preferably constructed as a laminate defined by a polymeric or copolymeric plastic member 16 (FIG. 5) to a forward face (unnumbered) of which is bonded a fabric layer 17 of aesthetically appropriate texture, design, color and/or the like. The elongated panel 15 includes an upper edge or edge portion 21 which is generally spaced from and is parallel to a lower edge or edge portion 22. The elongated panel 15 also includes side edges or edge portions 23, 24 each having a respective terminal edge 25, 26, respectively. The latter construction imparts a generally rectangular configuration to the overall display section 11 when in a substantially flat or uni-planar configuration. A forward facing or display side of the elongated panel 15 is generally designated by the reference numeral 27 and a rear side thereof is generally designated by the reference numeral 28.

Seven hollow elongated tubular rods or tubular members are generally designated by the reference numerals 31–37. The hollow members 31–37 are generally of a rectangular transverse configuration, and all are secured to the rear side 28 of the elongated panel 15 in gencrally spaced parallel relationship to each other. The hollow members 31, 37 are located immediately adjacent the respective terminal edges 25, 26. The hollow members 33, 35 are located at substantially vertically disposed transition zones 40, 41, respectively. The transition zones 40, 41 define a general transition zone between a central display panel portion 42 (FIG. 1) and opposite side panel portions 43, 44. The hollow member 32 is positioned substantially between the hollow members 31, 33 and the hollow member 36 is positioned substantially midway between the hollow members 35, 37. The hollow member 34 is positioned substantially midway between the terminal edges 25, 26. The hollow members 31, 33 carry magnetically attractive strips 51, 53, respectively, and the hollow members 35, 37 also carry magnetically attractive strips 55, 57, respectively.

The elongated panel 15 carries along the upper edge portion 21 of the rear side 28 a strip of hook and loop fabric fastening means 60, such as Velcro®, which extends generally between the hollow members 36, 37 and a similar strip 61 of hook and loop fabric fastening means, again such as Velcro®, between the hollow member 36 and the magnetically attractive strip 55 carried by the hollow member 35. An identical hook and loop strip 60 is secured to the rear side 28 of the upper edge 21 between the hollow members 31, 32 and a similar hook and loop strip 61 is secured to the rear side 28 of upper edge 21 of the elongated panel 15 between the hollow member 32 and the magnetically attractive strip 53 carried by the hollow member 33. Hook and loop strips 60, 61 are also identically so positioned along the lower edge portion 22 of the rear side 28 of the elongated panel 15. The purpose of the hook and loop fastening strips 60, 61 is to effectively fasten to similar hook and loop fabric strip 62 carried by the periphery of hub 63 provided with an outwardly opening radial slot 64 and a chordal opening 65 (FIGS. 3 and 6).

The rear side 28 of the lower edge portion 22 of the elongated panel 15 also carries two strips 71, 72 of magnetically attractive material. The strips 71, 72 are simply adhesively bonded to the rear side 28. The strip 71 extends between the hollow members 32, 34 while the strip 72 extends between the hollow members 34, 35.

Reference is now made to the display section 11' of the display 10 best shown in FIG. 3 which at its upper edge portion 21' is provided with magnetically attractive strips 71' and 72'. The strip 71' extends between the hollow member 33' and the hollow member 34' and the magnetically attractive strip 72' extends between the hollow member 34' and the hollow member 35'.

Two additional magnetically attractive strips 81, 82 (FIGS. 3 and 5) which are twice the width (or vertical height) of the strips 71, 71' and 72, 72' are utilized to maintain the two display systems 11 intimately fastened to each other by the lower edge portion 22 and the upper edge portion 21', as will be more apparent hereinafter.

Each of the hollow members 31'–37' of the display section 12 carries an upwardly directed cylindrical pin 90 which is secured in the position shown by an appropriate rivet 91 (FIG. 4) with an end thereof exposed such as to enter the respective hollow members 31–37.

The display section 12 does not have hook and loop) fastening strips corresponding to the strips 60, 61 along the lower edge portion 22'. Instead the fabric layer 17 which is on the front facing display side 27 is underfolded, at a lower edge portion thereof, upwardly and is bonded against the rear side 28' in the form of narrow folded strips or sections 74 which extend between the hollow members 31', 32'; 32', 33'; 33', 34'; 34', 35'; 35', 36'; and 36', 37'. It is to the overfolded fabric 74 that two of the hubs 63 are secured by the hook and loop fastening strips 62, as will be immediately apparent hereinafter.

The display 10 is normally packaged with the display sections 11, 12 first superimposed upon each other in a generally flat plane and then rolled from one side to the opposite side to form a two-panel (11, 12) roll which is housed in a shipping container and/or carrying case. Eight of the hubs 63 are stacked upon each other and are secured together in an appropriate fashion. The strips 81, 82 can be applied to either of the strips 71, 72 or 71', 72' prior to the panels being rolled or can simply be placed within the carrying case. A conventional display D (FIG. 1) of virtually any size desired is formed of one or more sections, and is preferably packaged within the carrying case together with a header H (FIG. 1). The display D and the header H is each conventionally provided with conventional hook and loop fabric fastening means for securing the same to the fabric layer 17 of the panel sections 11, 12.

After the rolled-up display sections 11, 12 are removed from the carrying case, and unrolled to a substantially flat, uni-planar condition with the hollow members 31–37 of the display sections 11 aligned with the hollow members 31'–37' of the display section 12.

The lower edge portion 22 of the display section 11 is slightly spaced from the upper edge portion 21' of the display section 12, as is generally illustrated in FIG. 4 which permits the sections 11, 12 to be moved relative toward each other projecting each of the pins 90 into the associated interior (unnumbered) of the hollow members 31–37. When the pins 90 are fully inserted into the hollow members 31–37, the magnetically attractive strips 71, 72 of the lower edge portion 22 of the display section 11 are immediately adjacent the magnetically attractive strip 71', 72' of the upper edge portion 21' of the display section 12, as is illustrated in FIG. 5. The magnetically attractive strips 81, 82 are then applied in overlying relationship to the respective magnetically attractive strips 71, 71' and 72, 72', as is most readily apparent from FIG. 5 of the drawings. The two display sections 11, 12 are now relatively firmly united to each other by virtue of the magnetically attractive means 71, 71', 81 and 72, 72', 82 as well as the pins 90 housed in the interiors of the hollow members 31–37.

The side portions 43, 44, 43' and 44' are rolled in the manner readily apparent in FIGS. 3, 6 and 7 of the drawings bringing the hollow members 31, 33; 31', 33'; 35, 37; and 35', 37' contiguous each other at which time the magnetically attractive strips 51, 53; 51', 53'; 55, 57; and 55', 57' will magnetically secure together to form the columnar upstanding side supports or side columns 43, 44 shown in FIGS. 1 and 2 of the drawings.

A hub 63 is then inserted into the upper end portion (unnumbered) of each side column 43, 43' and into the bottom end portions 21' of the side columns 43', 44', in the former case the hook and loop fabric strip 62 adhere to the hook and loop fabric strips 60, 61 and in the latter case, the hook and loop fabric strips 62 adhere to the overfolded end portion 74 of the fabric faces 17' within the side columns 43', 44'.

The display D (FIG. 1) and/or the header 11 can now be applied appropriately to the forward facing display side 27 of the display 10, as is shown in FIG. 1, which, it should be noted, illustrates the central panel portion 42 curved concavely opening in the direction of display viewing. This concave configuration is achieved because of the resilient nature of the elongated panels 15, 15' and, obviously, the degree of curvature can be regulated by varying the spacing between the hollow side columns 43, 43' and 44, 44'. Once this distance is established, the securement of the header H, by hook and loop fastening means or the like, prevents the columns from separating relative to each other and, thus, the desired established concave configuration is maintained until such time as the header H is removed and the distance between the side columns 43, 43' and 44, 44' is readjusted.

The manner in which the display 10 is erected is not only very straightforward, as the latter description evidences, but the same is accomplished rapidly in a straightforward manner, as is the essentially reversed steps to achieve knock-down and repackaging thereof.

Although a preferred embodiment of the invention has been specifically illustrated and described herein, it is to be understood that minor variations may be made in the apparatus without departing from the spirit and scope of the invention, as defined the appended claims.

I claim:

1. A display comprising a substantially resilient unbroken elongated single panel, said panel including opposite side panel portions and a central panel portion therebetween, said side panel portions being at least partially rolled in opposite directions to thereby define at least a partially columnar upstanding side support at each of opposite sides of said central panel portion, and means for maintaining each upstanding side support in its at least partially rolled columnar configuration.

2. The display as defined in claim 1 wherein said elongated panel includes a front display side and a rear side, and said side panel portions are rolled to the rear side of said elongated panel.

3. The display as defined in claim 1 wherein said central panel portion opens concavely in a forward facing display direction.

4. The display as defined in claim 1 wherein each side support is rolled substantially 360 degrees to define a substantially closed hollow columnar upstanding side support at each of said central panel portion sides.

5. The display as defined in claim 4 including a generally vertically disposed transition zone between each central panel portion and an adjacent side panel portion, each side panel portion having a terminal edge portion normally spaced from an adjacent vertically disposed transition zone when said elongated panel is substantially uniplanar, each side panel portion terminal edge portion being substantially contiguous and parallel to its associated adjacent transition zone when each of said side supports is in its substantially closed hollow columnar configuration, and said maintaining means are located at said terminal edge portions and at said transition zones.

6. The display as defined in claim 4 including a generally vertically disposed transition zone between each central panel portion and an adjacent side panel portion, each side panel portion having a terminal edge portion normally spaced from an adjacent vertically disposed transition zone when said elongated panel is substantially uniplanar, each side panel portion terminal edge portion being substantially contiguous and parallel to its associated adjacent transition zone when each of said side supports is in its substantially closed hollow columnar configuration, and said maintaining means are magnetic elements and magnetically attractive elements selectively located at least at one of each of said terminal edge portions and at said transition zones for magnetically attractively maintaining said side supports in the substantially closed hollow columnar configuration.

7. The display as defined in claim 4 including hub means in axially opposite ends of said hollow columnar side supports for imparting strength thereto and for maintaining the columnar configuration thereof.

8. The display as defined in claim 5 including an elongated rod disposed at each terminal edge and at each transition zone.

9. The display as defined in claim 5 including an elongated rod disposed at each terminal edge and at each transition zone, hub means in axially opposite ends of said hollow columnar side supports for imparting strength thereto and for maintaining the columnar configuration thereof, and slot means in each hub means for selectively receiving therein one of said elongated rods.

10. The display as defined in claim 5 including an elongated rod disposed at each terminal edge and at each transition zone, and said maintaining means are magnetically attractive elements selectively located at said terminal edge elongated rods and said transition zone elongated rods for magnetically attractively maintaining said side supports in the substantially closed hollow columnar configuration.

11. The display as defined in claim 1 including a vertically disposed transition zone between each central panel portion and an adjacent side panel portion, and each side panel portion having a terminal edge portion normally spaced from an adjacent vertically disposed transition zone when said elongated panel is substantially uniplanar.

12. The display as defined in claim 11 including hub means in axially opposite ends of said rolled at least partially columnar upstanding side supports for imparting strength thereto and for maintaining the columnar configuration thereof.

13. The display as defined in claim 11 including an elongated rod disposed at each terminal edge and at each transition zone.

14. The display as defined in claim 11 including an elongated rod disposed at each terminal edge and at each transition zone, hub means in axially opposite ends of said hollow columnar side supports for imparting strength thereto and for maintaining the columnar configuration thereof, and slot means in each hub means for selectively receiving therein an associated elongated rod.

15. The display as defined in claim 11 including an elongated rod disposed at each terminal edge and at each transition zone, and said maintaining means are magnetically attractive elements selectively located at said terminal edge elongated rods and said transition zone elongated rods for magnetically attractively maintaining said side supports in the substantially closed hollow columnar configuration.

16. A display comprising a pair of substantially uniformly resilient unbroken elongated single panels; each panel including opposite upper and lower edge portions, opposite side panel portions and a central panel portion therebetween; said panels being disposed with a lower edge of an upper panel contiguous an upper edge of a lower panel, means for holding said upper panel lower edge and said lower panel upper edge in contiguous relationship, and said side panel portions being at least partially rolled in opposite directions to thereby define at least a partially rolled columnar upstanding side support at each of opposite sides of said central panel portions.

17. The display as defined in claim 16 wherein said holding means include magnetically attractive means for holding together said upper panel lower edge and said lower panel upper edge.

18. The display as defined in claim 16 including means for effecting longitudinal alignment between said pair of panels whereby terminal side edge portions of said upper and lower panels are in generally aligned coincident relationship with each other.

19. The display as defined in claim 17 wherein one of said magnetically attractive means is carried by each of said tipper panel lower edge and said lower panel upper edge, and another of said magnetically attractive means is in spanning relationship to said one magnetically attractive means across said upper panel lower edge and said lower panel upper edge.

20. The display as defined in claim 19 wherein said other of said magnetically attractive means is a magnetic element.

21. The display as defined in claim 19 wherein said other of said magnetically attractive means is a magnetic strip.

22. The display as defined in claim 19 wherein said other of said magnetically attractive means is a magnetic resilient strip.

23. The display as defined in claim 16 including means for maintaining each upstanding side support in its at least partially columnar configuration.

24. The display as defined in claim 18 wherein said elongated panels each include a front display side and a rear side, and said side panel portions are rolled to the rear side of said elongated panels.

25. The display as defined in claim 16 wherein each side support is rolled substantially 360 degrees to define a substantially closed hollow columnar upstanding side support at each of said central panel side portions.

26. The display as defined in claim 25 including a generally vertically disposed transition zone between each central panel portion and an adjacent side panel portion, each side panel portion having a terminal edge portion normally spaced for an adjacent vertically disposed transition zone when said elongated panel is substantially uniplanar, each side panel portion terminal edge portion being substantially contiguous and parallel to its associated adjacent transition zone when each of said side supports is in its substantially closed hollow columnar configuration, and said maintaining means are located at said terminal edge portions and at said transition zones.

27. The display as filed in claim 26 including means for spanning said upper and lower edges at said transition zones for maintaining said elongated panels aligned in upper edge/lower edge contiguous relationship.

28. The display as defined in claim 26 including means for spanning said upper and lower edges at said terminal edge portions for maintaining said elongated panels aligned in upper edge/lower edge contiguous relationship.

29. The display as defined in claim 26 including means for spanning said upper and lower edges at said transition zones and at said terminal edge portions for maintaining said elongated panels aligned in upper edge/lower edge contiguous relationship.

30. The display as defined in claim 27 wherein said spanning means include at least one pair of telescopically united members.

31. The display as defined in claim 28 wherein said spanning means include at least one pair of telescopically united members.

32. The display as defined in claim 29 wherein said spanning means include at least one pair of telescopically united members.

* * * * *